US009661415B2

(12) United States Patent
Yeh et al.

(10) Patent No.: US 9,661,415 B2
(45) Date of Patent: May 23, 2017

(54) DIGITAL MICROPHONE SYSTEM, AUDIO CONTROL DEVICE, AND CONTROL METHOD THEREOF

(71) Applicant: REALTEK SEMICONDUCTORS CORP., HsinChu (TW)

(72) Inventors: Tsung-Li Yeh, Hsinchu (TW); Yi-Chang Tu, New Taipei (TW)

(73) Assignee: Realtek Semiconductor Corp., Hsinchu (TW)

( * ) Notice: Subject to any disclaimer, the term of this patent is extended or adjusted under 35 U.S.C. 154(b) by 725 days.

(21) Appl. No.: 13/855,299

(22) Filed: Apr. 2, 2013

(65) Prior Publication Data

US 2014/0112501 A1 Apr. 24, 2014

(30) Foreign Application Priority Data

Oct. 24, 2012 (TW) ..... 101139337 A

(51) Int. Cl.
*H04R 3/00* (2006.01)
*H04R 1/00* (2006.01)

(52) U.S. Cl.
CPC ..... *H04R 3/00* (2013.01); *H04R 1/005* (2013.01)

(58) Field of Classification Search
CPC ..... H04R 1/005; H04R 3/00; G06F 13/4045; G10L 19/16
USPC ..... 381/122, 111–115
See application file for complete search history.

(56) References Cited

U.S. PATENT DOCUMENTS

| | | | | |
|---|---|---|---|---|
| 5,886,658 | A | 3/1999 | Amar et al. | |
| 7,643,593 | B1 | 1/2010 | Macomber | |
| 2007/0133826 | A1* | 6/2007 | Burk | H04R 3/005 381/122 |
| 2007/0239438 | A1* | 10/2007 | Chuang | G10L 19/00 704/212 |
| 2009/0003629 | A1* | 1/2009 | Shajaan | H04R 1/005 381/113 |
| 2009/0265494 | A1* | 10/2009 | Toki | G06F 13/4045 710/110 |
| 2010/0114584 | A1* | 5/2010 | Weng | G10L 19/16 704/500 |
| 2010/0329487 | A1* | 12/2010 | David | G05F 3/30 381/174 |
| 2011/0185215 | A1 | 7/2011 | Neben | |
| 2013/0197920 | A1* | 8/2013 | Lesso | H04L 25/4902 704/500 |

FOREIGN PATENT DOCUMENTS

| | | | |
|---|---|---|---|
| TW | 200304755 | A | 10/2003 |
| TW | 200740257 | A | 10/2007 |

* cited by examiner

*Primary Examiner* — David Ton
(74) *Attorney, Agent, or Firm* — Muncy, Geissler, Olds & Lowe, P.C.

(57) ABSTRACT

A digital microphone system, audio control device and control method thereof is related to the method for controlling a digital microphone circuit including receiving a clock signal; detecting that the clock signal is maintained at a predetermined level for a duration; when the duration reaches a given time, switching a transmission type of a data pin; in a data mode, outputting a digital audio signal to a data line via the data pin in an output type; and in a command mode, receiving a command signal from the data line via the data pin in an input type.

11 Claims, 7 Drawing Sheets

DIGITAL MICROPHONE SYSTEM, AUDIO CONTROL DEVICE, AND CONTROL METHOD THEREOF

CROSS-REFERENCES TO RELATED APPLICATIONS

This non-provisional application claims priority under 35 U.S.C. §119(a) on Patent Application No. 101139337 filed in Taiwan, R.O.C. on 2012 Oct. 24, the entire contents of which are hereby incorporated by reference.

BACKGROUND OF THE INVENTION

Technical Field

The present invention relates to a two-way communication technology between a digital microphone circuit and an audio control device, and more particularly to a digital microphone system, an audio control device, and a control method thereof.

Related Art

A microphone is a device capable of converting a sound wave into an electronic signal. Conventionally, the microphone is generally designed to be an analog microphone, which converts a pressure wave hitting an active surface of the microphone into an analog output signal by using a piezoelectric crystal, a capacitor, or the like, that is, the sound wave causes a charged diaphragm to vibrate, then the voltage of the capacitor plate is changed to generate an analog signal, then the analog signal is amplified, and then the amplified analog signal is transmitted to a recording device. However, the disadvantage of the conventional analog microphone is that the generated analog signal is very sensitive to external interference, so the quality of the analog signal is unstable and is strongly affected by external interference.

If the analog microphone is externally connected to or built in a computer system, capture and a transmission path of an analog audio signal are affected significantly by external interference in the system plane, for example, high-frequency noise generated by a high-speed operation on a Printed Circuit Board (PCB), seriously affecting the quality of the analog audio signal.

Therefore, a design of a digital microphone has been proposed in which a received analog audio signal is presented in a digital manner and then transmitted, so the influence of the external interference on the captured audio signal is reduced due to immunity of the digital signal to the noise. Basically, Please refer to FIG. 1, the concept of the digital microphone is as follows. Through a digital sampling mechanism, an analog audio signal generated by a digital microphone circuit 10 is converted in to a digital audio signal DATA, then an audio CODEC chip 20 is used to further perform a digital filtering operation, and then generated audio data in a digital format suitable for storage and play is transmitted to a computer system 30 for storage and play. Since the audio signal is already converted into a digital form at the beginning of receiving, the signal is not significantly polluted by various noise sources in the transmission path.

However, when an audio signal collected from the outside exceeds a gain range of a preamplifier of a digital microphone circuit, the audio signal collected by the digital microphone is distorted due to a too large gain. Additionally, restoration cannot be performed on the distorted audio signal through post-production processing of hardware or software. Conversely, when an audio signal collected from the outside is too weak and an amplification gain of a preamplifier is still relatively insufficient, although an audio CODEC chip or an audio controller can perform post-production processing to amplify the audio signal, noise of elements of the digital microphone circuit is relatively amplified, so that a signal-to-noise ratio (SNR) becomes small. In other words, since a transmission interface of the digital microphone circuit is a two-line transmission channel for one-way communication, the digital microphone circuit can only collect an audio signal according to set element performance (for example, a fixed pre-amplification gain), so that an energy range of the collected audio signal is limited.

SUMMARY

In an embodiment, a method for controlling a digital microphone circuit includes: receiving a clock signal; detecting that the clock signal is maintained at a predetermined level for a duration; when the duration reaches a given time, switching a transmission type of a data pin; in a data mode, outputting a digital audio signal to a data line via the data pin in an output type; and in a command mode, receiving a command signal from the data line via the data pin in an input type.

In an embodiment, a method for controlling an audio control device is applicable to an audio control device, and the audio control device is used to control a digital microphone circuit. The digital microphone circuit has a first timing pin and a first data pin, and the audio control device has a second timing pin and a second data pin.

The method for controlling an audio control device includes: outputting a clock signal to the first timing pin via the second timing pin; maintaining the clock signal at a predetermined level; when the clock signal is continuously maintained at the predetermined level for a first given time, switching a transmission type of the first data pin from an output type to an input type; when the clock signal is continuously maintained at the predetermined level for a second given time, switching a transmission type of the second data pin from an input type to an output type; and after the second data pin is switched to the output type, outputting the clock signal having multiple pulses to the first timing pin via the second timing pin, and outputting a command signal to the first data pin in the input type via the second data pin in the output type in response to an edge of the clock signal. The first given time is less than or equal to the second given time.

In an embodiment, the digital microphone system includes a digital microphone circuit. The digital microphone circuit includes a sensor, a gain adjustment unit, a modulation circuit, a command processing unit, a first timing pin, a first data pin, a first switching unit, and a timing detection unit.

In the data mode, the sensor senses an external sound wave and correspondingly generates an analog audio signal. The gain adjustment unit adjusts magnitude of the analog audio signal according to a gain value, and the modulation circuit converts the adjusted analog audio signal into a digital audio signal.

The first timing pin receives a clock signal. The timing detection unit detects the clock signal and controls operation of the switching unit according to the clock signal. The switching unit performs selection according to control of the timing detection unit, so that the first data pin is in an input type or an output type.

When the data pin is in the output type, the first data pin is electrically connected to the modulation circuit via the first switching unit, so as to enable the modulation circuit to output the digital audio signal via the first data pin according to an edge of the clock signal. When the data pin is in the input type, the first data pin is electrically connected to the command processing unit via the first switching unit, so as to enable the command processing unit to receive a command signal via the first data pin.

In some embodiments, the digital microphone system may further include an audio control device.

In an embodiment, an audio control device is used to control a digital microphone circuit having a first timing pin and a first data pin, and the audio control device includes a signal processing unit, a signal generation unit, a second timing pin, a second data pin, a switching unit, a timing generation unit, and a signal detection unit.

The second timing pin is electrically connected to the first timing pin, and the second data pin is electrically connected to the first data pin.

The timing generation unit generates a clock signal and outputs the clock signal via the second timing pin.

The switching unit performs selection according to control of the signal detection unit, so that the second data pin is in an input type or an output type. When the second data pin is in the input type, the second data pin receives a digital audio signal, and the signal processing unit performs post-production processing on the digital audio signal. When the second data pin is in the output type, the second data pin outputs the command signal generated by the signal generation unit.

Here, the signal detection unit detects the digital audio signal, controls operation of the switching unit and the signal generation unit according to the digital audio signal, and enables the timing generation unit to generate the corresponding clock signal.

In summary, the digital microphone circuit, the audio control device and the control methods thereof according to the present invention can enable a single data channel having a two-way transmission function to exist between the digital microphone circuit and the audio control device. In some embodiments, the audio control device can regulate the digital microphone circuit according to an audio signal collected by the digital microphone circuit.

BRIEF DESCRIPTION OF THE DRAWINGS

The disclosure will become more fully understood from the detailed description given herein below for illustration only, and thus not limitative of the present invention, wherein.

DETAILED DESCRIPTION

The terms "first" and "second" are used to distinguish indicated elements but not to order indicated elements or limit the difference between the indicated elements and not to limit the scope of the present invention.

Figure 1:
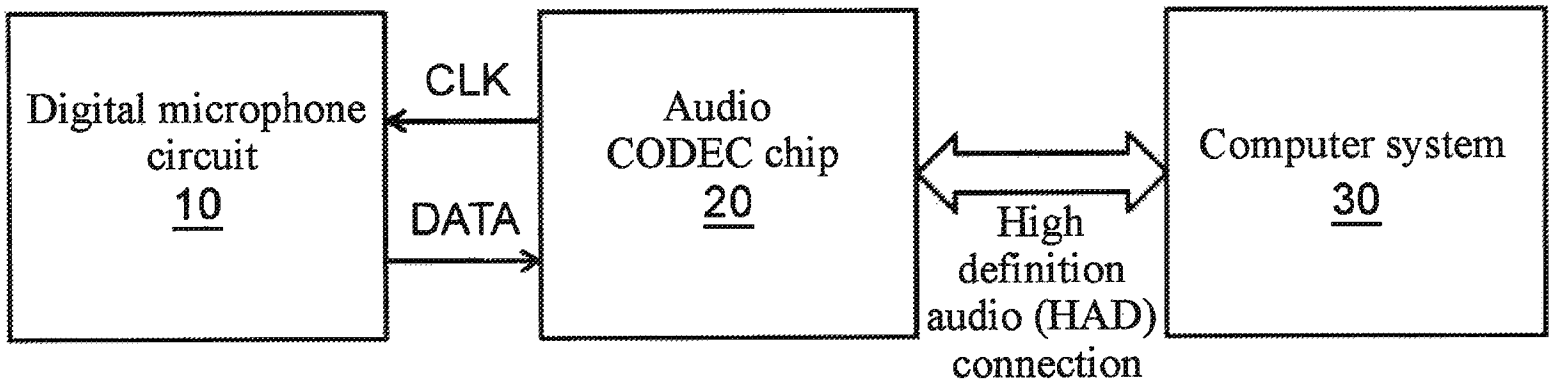
FIG. 1 (Prior Art)
FIG. 1 is a schematic diagram of application of a digital microphone system of the prior art.
Figure 2:
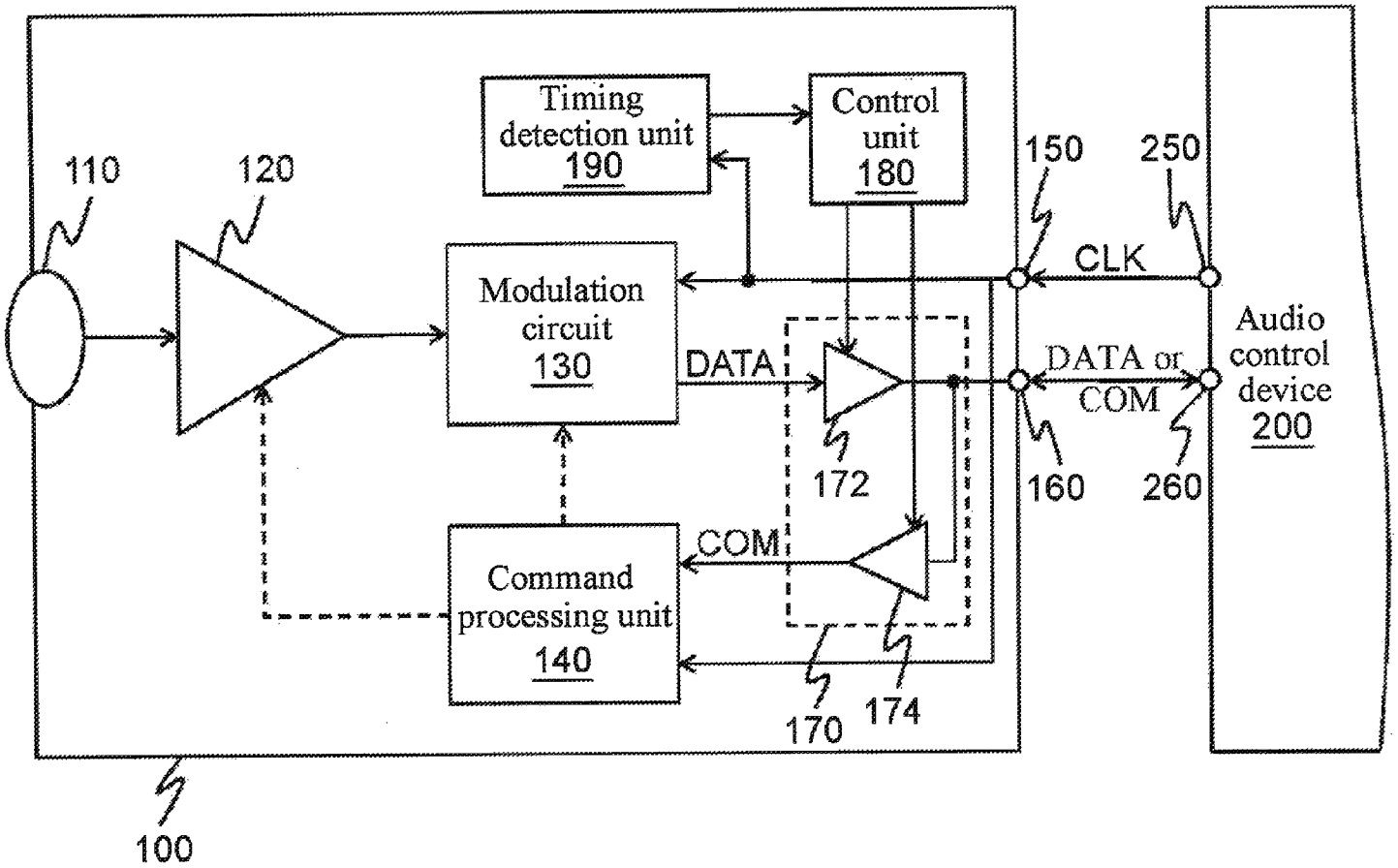
FIG. 2 is a schematic diagram of a digital microphone circuit according to an embodiment of the present invention.
Figure 3:
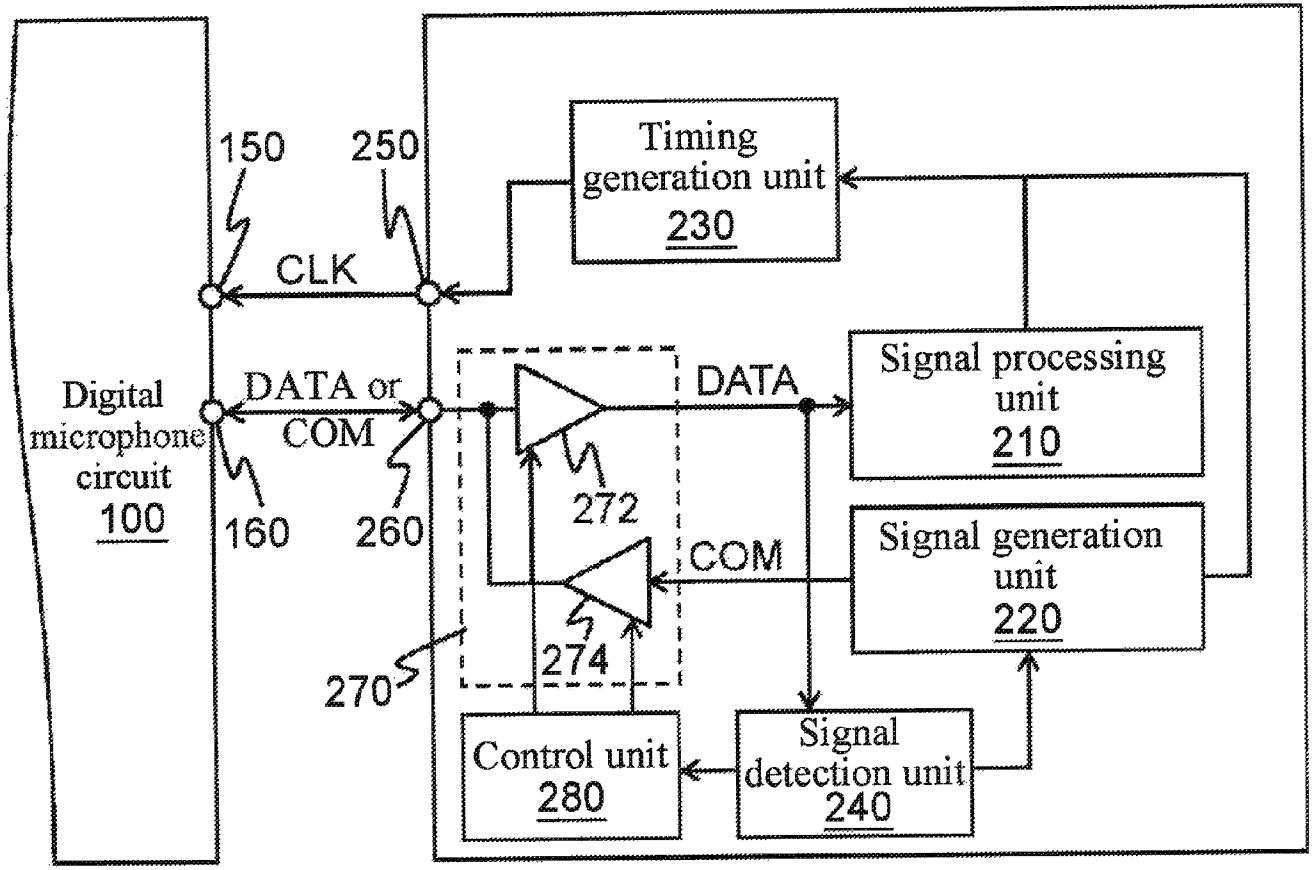
FIG. 3 is a schematic diagram of an audio control device according to an embodiment of the present invention.

Please refer to FIG. 2 and FIG. 3, in which a digital microphone system includes a digital microphone circuit 100 and an audio control device 200.

The digital microphone circuit 100 and the audio control device 200 are connected by a transmission interface with a two-line transmission channel (that is, a timing line and a data line). In some embodiments, the audio control device 200 may be an audio CODEC chip or a controller.

The digital microphone circuit 100 includes a sensor 110, a gain adjustment unit 120, a modulation circuit 130, a command processing unit 140, a timing pin 150, a data pin 160, a switching unit 170, a control unit 180, and a timing detection unit 190.

The audio control device 200 includes a signal processing unit 210, a signal generation unit 220, a timing generation unit 230, a signal detection unit 240, a timing pin 250, a data pin 260, a switching unit 270, and a control unit 280.

For convenience of description, hereinafter the timing pin of the digital microphone circuit 100 is called a first timing pin 150, the data pin of the digital microphone circuit 100 is called a first data pin 160, the switching unit of the digital microphone circuit 100 is called a first switching unit 170, the timing pin of the audio control device 200 is called a second timing pin 250, the data pin of the audio control device 200 is called a second data pin 260, and the switching unit of the audio control device 200 is called a second switching unit 270.

In the digital microphone circuit 100, the gain adjustment unit 120 is electrically connected between the sensor 110 and the modulation circuit 130, and the modulation circuit 130 is electrically connected between the gain adjustment unit 120 and the first timing pin 150. The first switching unit 170 is electrically connected between the modulation circuit 130 and the first data pin 160 and between the command processing unit 140 and the first data pin 160. The timing detection unit 190 is electrically connected to the first timing pin 150, and the control unit 180 is electrically connected between the timing detection unit 190 and the first switching unit 170.

In some embodiments, the command processing unit 140 may be electrically connected to at least one element, for example, the gain adjustment unit 120 and/or the modulation circuit 130, of the digital microphone circuit 100 according to an object to be controlled.

Here, the first switching unit 170 is used to control a data direction of the first data pin 160. In other words, the first switching unit 170 may select an input type or an output type to be a transmission type of the first data pin 160. The control unit 180 is used to control operation of the first switching unit 170 in response to a detection result of the timing detection unit 190.

In some embodiments, the first switching unit 170 may include two buffers 172 and 174. An input end of the buffer 172 is coupled to the modulation circuit 130 and an output end of the buffer 172 is coupled to the first data pin 160. An input end of the buffer 174 is coupled to the first data pin 160 and an output end of the buffer 172 is coupled to the command processing unit 140.

The control unit 180 controls the buffers 172 and 174 to be actuated or not to decide the transmission type of the first data pin 160. When the control unit 180 enables the buffer 172 and disables the buffer 174, the transmission type of the first data pin 160 is the output type; on the contrary, when the control unit. 180 disables the buffer 172 and enables the buffer 174, the transmission type of the first data pin 160 is the input type.

In the audio control device 200, the second switching unit 270 is electrically connected between the signal processing unit 210 and the second data pin 260 and between the signal generation unit 220 and the second data pin 260, The signal detection unit 240 is electrically connected between the switching unit 270 and the signal generation unit 220, and the control unit 280 is electrically connected between the second switching unit 270 and the signal detection unit 240. The timing generation unit 230 is electrically connected between the second timing pin 250 and the signal processing unit 210 and between the second timing pin 250 and the signal generation unit 220.

Here, the second switching unit 270 is used to control a data direction of the second data pin 260. In other words, the second switching unit 270 may select an input type or an output type to be a transmission type of the second data pin 260. The control unit 280 is used to control operation of the second switching unit 270 in response to a detection result of the signal detection unit 240.

In some embodiments, the second switching unit 270 may include two buffers 272 and 274. An input end of the buffer 272 is coupled to the second data pin 260 and an output end of the buffer 272 is coupled to the signal processing unit 210. An input end of the buffer 274 is coupled to the signal generation unit 220 and an output end of the buffer 274 is coupled to the second data pin 260.

The control unit 280 controls the buffers 272 and 274 to be actuated or not to decide the transmission type of the second data pin 260. When the control unit 280 enables the buffer 272 and disables the buffer 274, the transmission type of the second data pin 260 is the input type; on the contrary, when the control unit 280 disables the buffer 272 and enables the buffer 274, the transmission type of the second data pin 260 is the output type.

In the digital microphone system, the second timing pin 250 is electrically connected to the first timing pin 150 by a timing line, and the second data pin 260 is electrically connected to the first data pin 160 by a data line, so as to achieve communication between the digital microphone circuit 100 and the audio control device 200. For example, the digital microphone circuit 100 and the audio control device 200 may communicate with each other through a two-channel (that is, a timing line and a data line), transmission interface.

Here, the data line is used for two-way transmission, so the digital microphone system has three modes, that is, a data mode, a turnaround mode, and a command mode. In other words, in the digital microphone system, the audio control device 200 is used to control operation of the digital microphone circuit 100 (the data mode), and adjust performance of the digital microphone circuit 100 according to feedback of a digital audio signal DATA collected by the digital microphone circuit 100 (that is, enter the command mode).

Figure 4:
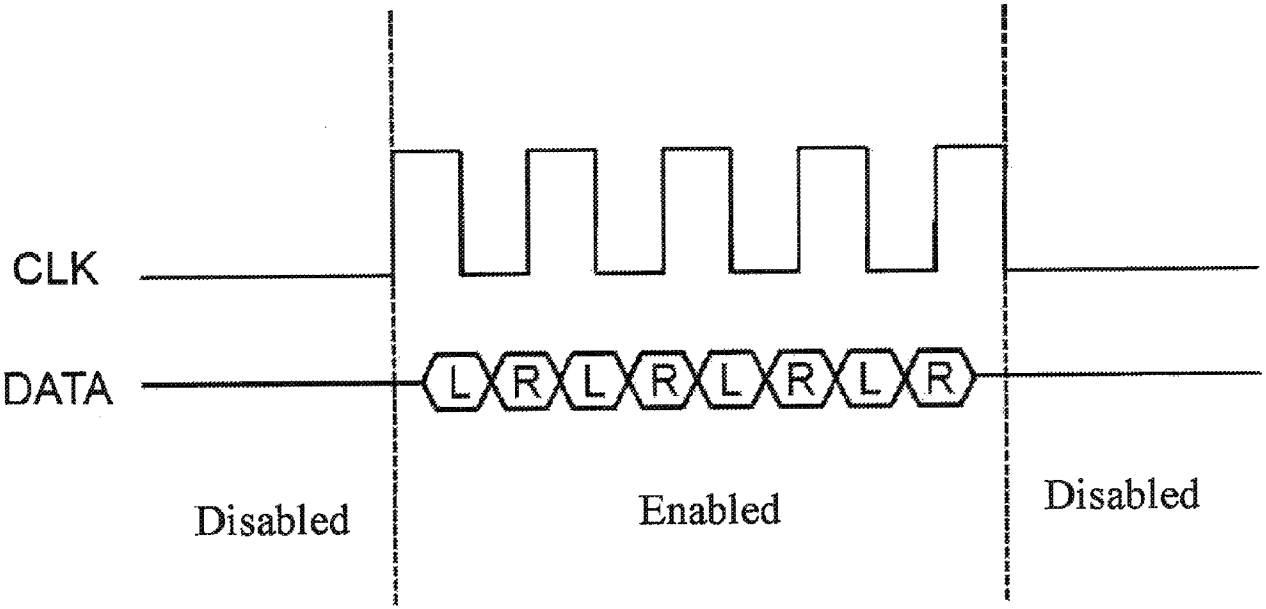
FIG. 4 is a schematic signal diagram of a transmission interface of a digital microphone system in a data mode according to an embodiment of the present invention.

Please refer to FIG. 4, in which in the data mode, the second data pin 260 is of the input type, and the first data pin 160 is of the output type.

Here, the digital microphone system has two states, an enabled state and a disabled state.

When the audio control device 200 does not require the digital microphone circuit 100 to collect a signal, the audio control device 200 does not send a clock signal CLK to the digital microphone circuit 100, so as to achieve the disabled state.

In the enabled state, the timing generation unit 230 generates a clock signal CLK having multiple pulses, and outputs the clock signal CLK to the digital microphone circuit 100 via the second timing pin 250, so as to enable the digital microphone circuit 100 collects external sound.

In this case, the sensor 110 senses an external sound vibration (that is, a sound wave), and converts the sound vibration into an electronic analog signal (that is, an analog audio signal). The gain adjustment unit 120 adjusts the collected analog audio signal according to a gain value. The modulation circuit 130 samples and modulates the adjusted analog audio signal, so as to convert the analog audio signal into a digital audio signal DATA presented in a unit of 1 bit. The modulation circuit 130 outputs the digital audio signal DATA to the data line via the first data pin 160 in the output type according to an edge of the clock signal CLK.

Two audio channels are taken as an example. The modulation circuit 130 may transmit the digital audio signal DATA to the audio control device 200 via the data line appropriately at a rising edge or a falling edge of the clock signal CLK according to setting of an audio channel setting signal (not shown).

For example, please refer to FIG. 4, in which left audio channel data L is output to the audio control device 200 at the rising edge of the clock signal CLK. Right audio channel data R is output to the audio control device 200 at the falling edge of the clock signal CLK.

In some embodiments, the gain adjustment unit 120 may be a preamplifier, for amplifying the collected analog audio signal according to a gain value of the preamplifier. The preamplifier is well known by persons skilled in the art, so the detailed operation principle of the preamplifier is not described here again. The modulation circuit 130 may include an analog-to-digital converter and a pulse density modulation (PDM) modulator or include a sigma-delta modulator. Operation of the analog-to-digital converter and the modulator is well known by persons skilled in the art, so the detailed operation principles of the analog-to-digital converter and the modulator are not described here again.

At the audio control device 200, the digital audio signal DATA received via the second data pin 260 is transmitted to the signal processing unit 210 via the second switching unit 270.

In this case, the signal processing unit 210 mainly assists a host system (for example, a computer system), in processing operations involving audio coding, decoding and output. In this embodiment, the signal processing unit 210 may directly bypass the received digital audio signal DATA to the host system, or perform postproduction audio processing and then bypass the processed digital audio signal DATA to the host system.

At the same time, the signal detection unit 240 detects whether energy of the received digital audio signal DATA falls outside a given range, that is, exceeds or is lower than a given range.

Figure 5:
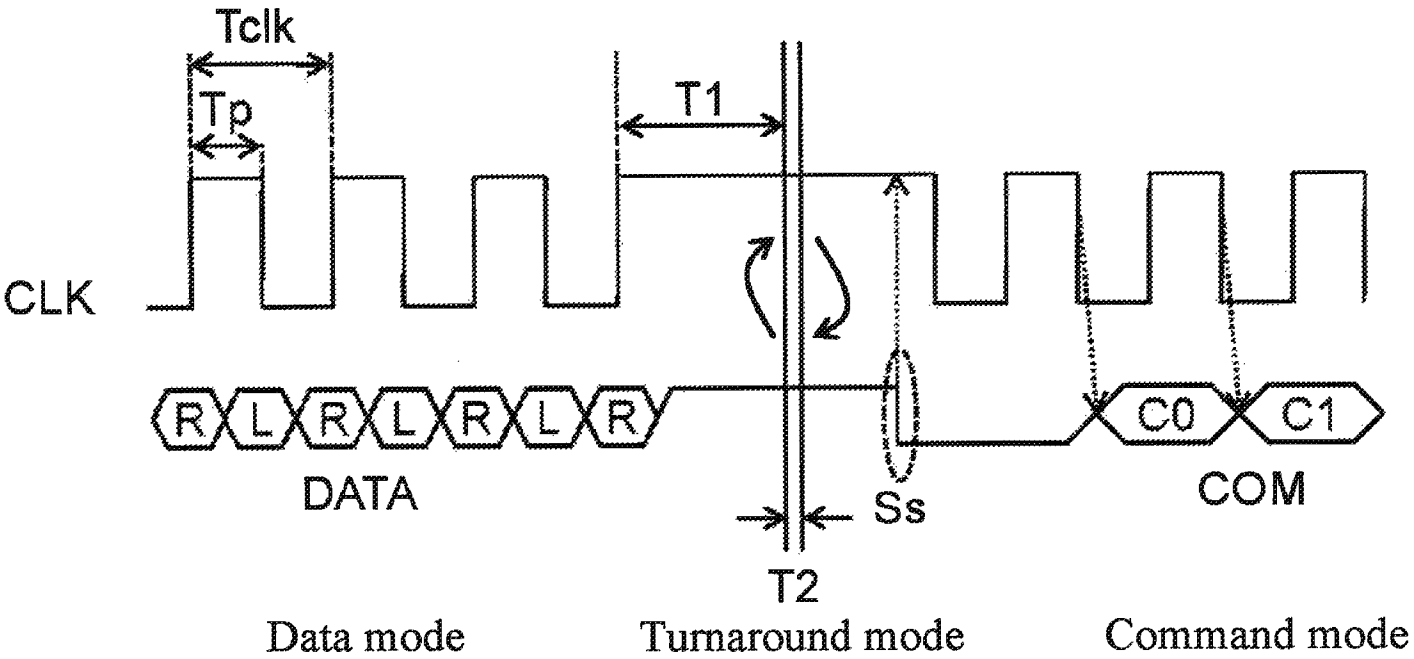
FIG. 5 is a schematic signal diagram of a transmission interface of a digital microphone system in a turnaround mode according to an embodiment of the present invention.

Please refer to FIG. 5, in which when the signal detection unit 240 detects that energy of the received digital audio signal DATA falls outside a given range, the signal detection unit 240 enables the timing generation unit 230 to generate a clock signal CLK maintained at a predetermined level, so as to enter the turnaround mode. The clock signal CLK of the predetermined level is output to the digital microphone circuit 100 via the second timing pin 250 and the timing line. In some embodiments, the predetermined level may selectively be a high level or a low level. In some embodiments, the predetermined level is inverse to a level of the clock signal in the disabled state of the data mode. In other words, the predetermined level is inverse to a level of the clock signal indicating a disabled state when the transmission type of the second data pin is the input type.

For example, in the data mode, when the clock signal CLK is continuously maintained at a low level, the digital microphone system (the digital microphone circuit 100), is in the disabled state. In this case, the predetermined level is set to a high level.

In some embodiments, the first timing pin 150 or the second timing pin 250 may be coupled to an inverter. In the data mode, when the clock signal CLK generated by the timing generation unit 230 is transmitted to the modulation circuit 130 and the timing detection unit 190 via the first timing pin 150 and the second timing pin 250, the clock signal CLK is inverted by the inverter during transmission. In this case, the digital microphone circuit 100 is in the disabled state since the received clock signal CLK is continuously maintained at a high level. Here, the predetermined level is set to a low level.

The timing detection unit 190 receives the clock signal CLK of the predetermined level via the first timing pin 150 and detects a duration when the clock signal CLK is at the predetermined level. When the timing detection unit 190 detects that the duration reaches a first given time T1, the timing detection unit 190 enables the switching unit 170 to switch the transmission type of the first data pin 160 from the output type to the input type.

When the timing generation unit 230 continuously generates the clock signal CLK of the predetermined level for a second given time (T1+T2), the signal detection unit 240 enables the switching unit 270 to switch the transmission type of the second data pin 260 from the input type to the output type, and the digital microphone system enters the command mode, that is, the digital microphone circuit 100 and the audio control device 200 enter the command mode.

In some embodiments, the first given time T1 is greater than a time Tp, that is, a pulse width, of a single pulse of the clock signal CLK in the data mode. In other words, the first given time T1 is greater than the time Tp of a single pulse of the clock signal CLK corresponding to the digital audio signal DATA. Preferably, the first given time T1 is greater than a time Tclk of a cycle of the clock signal CLK in the data mode, that is, greater than the time Tclk of a cycle of the clock signal CLK corresponding to the digital audio signal DATA.

In some embodiments, the first given time T1 is less than or equal to the second given time (T1+T2). In other words, the first data pin 160 and the second data pin 260 may be switched at the same time, that is, the first given time T1 is equal to the second given time (T1+T2). Preferably, the first data pin 160 is switched to the input type first, and then the second data pin 260 is switched to the output type, that is, the first given time T1 is less than the second given time (T1+T2).

In some embodiments, the given range may be a first threshold, and the signal detection unit 240 detects whether energy of the digital audio signal DATA is greater than the first threshold. When the signal detection unit 240 detects that the energy of the digital audio signal DATA is greater than the first threshold, it indicates that the external sound is greater than a sound collection range of the digital microphone circuit 100. In this case, the signal detection unit 240 enables the timing generation unit 230 to generate a clock signal CLK maintained at a predetermined level, so as to enter the turnaround mode, to regulate setting of the digital microphone circuit 100 after the transmission type is turned around, for example, to increase a gain value of the gain adjustment unit 120 or modulate the performance of the modulation circuit 130.

In some embodiments, the given range may be a second threshold, and the signal detection unit 240 detects whether energy of the digital audio signal DATA is less than the second threshold. When the signal detection unit 240 detects that the energy of the digital audio signal DATA is less than the second threshold, it indicates that the external sound is less than a sound collection range of the digital microphone circuit 100. In this case, the signal detection unit 240 enables the timing generation unit 230 to generate a clock signal CLK maintained at a predetermined level, so as to enter the turnaround mode, to regulate setting of the digital microphone circuit 100 after the transmission type is turned around, for example, to decrease a gain value of the gain adjustment unit 120 or modulate the performance of the modulation circuit 130.

In some embodiments, the given range may be a range formed by the first threshold and the second threshold, and the signal detection unit 240 detects whether energy of the digital audio signal DATA is greater than the first threshold or less than the second threshold. Upon detecting that energy of the digital audio signal DATA is greater than the first threshold or less than the second threshold, the signal detection unit 240 enables the timing generation unit 230 to generate a clock signal CLK maintained at a predetermined level, so as to enter the turnaround mode, to correspondingly regulate setting of the digital microphone circuit 100 after the transmission type is turned around.

After the transmission type of the first data pin 160 is switched to the input type and the transmission type of the second data pin 260 is switched to the output type, the digital microphone system enters the command mode.

Figure 6:
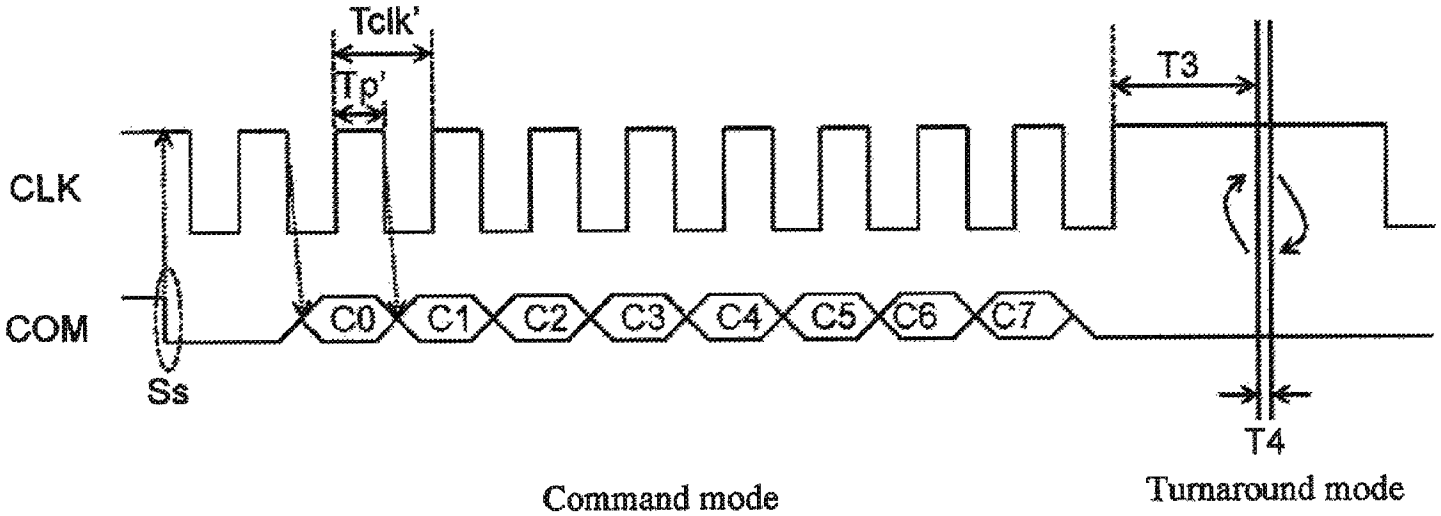
FIG. 6 is a schematic signal diagram of a transmission interface of a digital microphone system in a command mode according to an embodiment of the present invention.

In the command mode (please refer to FIG. 6), the timing generation unit 230 generates a clock signal CLK having multiple pulses, and outputs the clock signal CLK to the digital microphone circuit 100 via the second timing pin 250. At the same time, the signal generation unit 220 generates a command signal COM and outputs the command signal COM to the data line via the second data pin 260 in the output type according to an edge of the clock signal CLK.

The command processing unit 140 receives the command signal COM from the data line via the first data pin 160 in the input type, and correspondingly adjusts setting of at least one element of the digital microphone circuit 100 according to commands C0 to C7 of the command signal COM; for example, increases or reduces the gain value of the gain adjustment unit 120 or improves or reduces the performance of the modulation circuit 130, so as to enable the digital microphone circuit 100 to have a sound collection range or power supply corresponding to pre-collection, thereby providing the performance of the digital microphone circuit 100. It should be specially noted that the number of the commands in the command signal COM is not limited to the number of the commands C0 to C7, and the number of the commands in the command signal COM may be decided according to design specifications.

In some embodiments, after the commands C0 to C7 are generated the signal generation unit 220 can enable the timing generation unit 230 to generate a clock signal CLK maintained at a predetermined level, to enter the turnaround mode.

When the timing generation unit 230 continuously generates the clock signal CLK maintained at the predetermined level for a third given time T3, the second switching unit 270 switches the transmission type of the second data pin 260 from the output type back to the input type.

The clock signal CLK of the predetermined level is output to the digital microphone circuit 100 via the second timing pin 250 and the timing line. The timing detection unit 190 receives the clock signal CLK of the predetermined level via the first timing pin 150 and detects a duration when the clock signal CLK is at the predetermined level. When the timing detection unit 190 detects that the duration reaches a fourth given time (T3+T4), the timing detection unit 190 enables the first switching unit 170 to switch the transmission type of the first data pin 160 from the input type to the output type.

After the transmission type of the second data pin 260 is switched back to the input type and the transmission type of the first data pin 160 is switched back to the output type, the digital microphone system enters the data mode again.

In some embodiments, the third given time T3 is greater than a time Tp', that is, a pulse width, of a single pulse of the clock signal CLK in the command mode. In other words, the third given time T3 is greater than the time Tp' of a single pulse of the clock signal CLK corresponding to the command signal COM. Preferably, the third given time T3 is greater than a time Tclk' of a cycle of the clock signal CLK in the command mode, that is, greater than the time Tclk' of a cycle of the clock signal CLK corresponding to the command signal COM.

In some embodiments, the third given time T3 is less than or equal to the fourth given time (T3+T4). In other words, the first data pin 160 and the second data pin 260 may be switched at the same time, that is, the third given time T3 is equal to the fourth given time (T3+T4). Preferably, the second data pin 260 is switched to the input type first, and then the first data pin 160 is switched to the output type, that is, the third given time T3 is less than the fourth given time (T3+T4).

In some embodiments, the fourth given time (T3+T4) may be different from the first given time T1.

In some embodiments, the fourth given time (T3+T4) may also be the same as the first given time T1. In other words, the timing detection unit 190 detects, according to a preset fixed time, a duration when the clock signal CLK is at the predetermined level. Upon detecting that the duration reaches the preset fixed time, the timing detection unit 190 enables the first switching unit 170 to switch the transmission type of the first data pin 160.

In some embodiments, each command signal COM may have the same number of commands C0 to C7. Therefore, the command processing unit 140 may enable, by calculating the number of received commands C0 to C7, the first switching unit 170 to switch the transmission type of the first data pin 160.

A single audio channel and fixed eight commands are taken as an example. After the signal generation unit 220 outputs the eighth command C7, the signal generation unit 220 enables the second switching unit 270 to switch the transmission type of the second data pin 260 back to the input type. After the command processing unit 140 receives the eighth command C7, the command processing unit 140 enables the first switching unit 170 to switch the transmission type of the first data pin 160 back to the output type. In this way, the digital microphone system returns to the data mode again.

Two audio channels and fixed eight commands are taken as an example. The signal generation unit 220 may first output eight commands of a first audio channel (for example, a left audio channel), and then output eight commands of a second audio channel (for example, a right audio channel). After the signal generation unit 220 outputs the eighth command C7 of the second audio channel, the signal generation unit 220 enables the second switching unit 270 to switch the transmission type of the second data pin 260 back to the input type. In this case, the command processing unit 140 may be correspondingly set to be an element controlling the first audio channel when receiving the first to eight commands and an element controlling the second audio channel when receiving the ninth to sixteenth commands. Additionally, after the command processing unit 140 receives the sixteenth command, the command processing unit 140 enables the first switching unit 170 to switch the transmission type of the first data pin 160 back to the output type.

Figure 7:
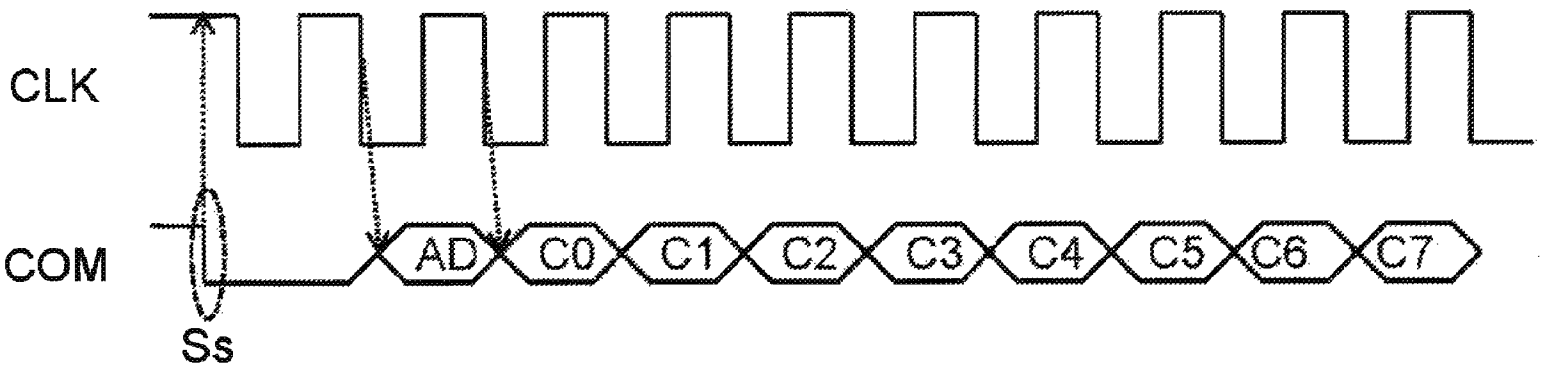
FIG. 7 is a schematic signal diagram of a transmission interface of a digital microphone system in a command mode according to another embodiment of the present invention.

In some embodiments, (please refer to FIG. 7), each command signal COM may also have commands C0 to C7 of arbitrary lengths. In this case, the command signal COM may have an address AD. Here, the address AD may be used to indicate an audio channel or element to which commands C0 to C7 following the address AD belong. The command processing unit 140 can know, from the address AD, an audio channel or element to be adjusted.

In some embodiments, (please refer to FIG. 5, FIG. 6, and FIG. 7), after the transmission type of the second data pin 260 is switched from the input type to the output type, before outputting the command signal COM, the signal generation unit 220 may generate a starting signal Ss first and output the starting signal Ss to the data line via the second data pin 260.

The command processing unit 140 receives the starting signal Ss via the first data pin 160 and prepares to receive a first command signal according to the starting signal Ss and the clock signal CLK corresponding to the starting signal Ss. Here, a level of the clock signal CLK corresponding to the starting signal Ss is decided according to an edge of the clock signal CLK to which generation of the command signal COM responds.

In some embodiments, the starting signal Ss is a signal transition, for example, falling from a high level to a low level or rising from a low level to a high level.

When the first data pin 160 receives the starting signal Ss (that is, a signal from the data line undergoes signal transition), and while the clock signal CLK received by the first timing pin 150 is at the first level, the command processing unit 140 prepares to receive the first command signal.

For example, in the command mode, the signal generation unit 220 generates the commands C0 to C7 in response to the falling edge of the clock signal CLK. Transition phenomena between the commands C0 to C7 may occur, and a level of a clock signal CLK corresponding to a transition between two adjacent commands is a low level. In this case, the first level of the clock signal CLK is set to a high level, to distinguish the starting signal Ss and the commands, thereby avoiding misjudgment. Here, the starting signal Ss may be a falling edge, that is, a signal transition of falling from a high level to a low level, and the level of the clock signal CLK corresponding to the starting signal Ss is a high level, so as to notify the command processing unit 140 of preparing to receive the first command signal. On the contrary, in the command mode, if the signal generation unit 220 generates the commands C0 to C7 in response to a rising edge of the clock signal CLK, the first level of the clock signal CLK is set to a low level, so as to avoid misjudgment. Therefore, the command processing unit 140 can know, according to a signal combination of the starting signal Ss and the clock signal CLK at the first level, the timing of preparing to receive and process the command signal COM.

In summary, the digital microphone system, the audio control device and the control method thereof according to the present invention can enable a single data channel having a two-way transmission function to exist between the digital microphone circuit and the audio control device. In some embodiments, the audio control device can regulate the digital microphone circuit according to an audio signal collected by the digital microphone circuit.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A method for controlling a digital microphone circuit, comprising:

receiving, by a first device, a clock signal generated by a second device;

detecting, by the first device, that the clock signal from the second device is maintained at a predetermined level for a duration;

switching a transmission type of a data pin when the duration reaches a given time;

in a data mode, outputting a digital audio signal to a data line via the data pin with the transmission type being an output type; and in a command mode, receiving a command signal from the data line via the data pin with the transmission type being an input type.

2. The method for controlling a digital microphone circuit according to claim 1, wherein in the data mode, when the given time is greater than a time of a single pulse of the clock signal in the data mode, the transmission type of the data pin is switched from the output type to the input type.

3. The method for controlling a digital microphone circuit according to claim 1, wherein in the command mode, when the given time is greater than a time of a single pulse of the clock signal in the command mode, the transmission type of the data pin is switched from the input type to the output type.

4. The method for controlling a digital microphone circuit according to claim 1, further comprising:

in the command mode, calculating the number of commands of the received command signal; and when the number of the commands reaches a given number, switching the transmission type of the data pin from the input type to the output type, and entering the data mode.

5. The method for controlling a digital microphone circuit according to claim 1, further comprising:

in the command mode, receiving a starting signal via the data pin with the transmission type being the input type, wherein the starting signal is a signal transition, and a level of the clock signal corresponding to the signal transition is decided according to an edge of the clock signal to which generation of the command signal responds.

6. The method for controlling a digital microphone circuit according to claim 1, wherein the predetermined level is inverse to a level of the clock signal in a disabled state of the data mode.

7. A method for controlling an audio control device, applicable to an audio control device, wherein the audio control device is used to control a digital microphone circuit, the digital microphone circuit has a first timing pin and a first data pin, the audio control device has a second timing pin and a second data pin, the control method comprising:

outputting a clock signal to the first timing pin via the second timing pin;

maintaining the clock signal at a predetermined level;

switching a transmission type of the first data pin from an output type to an input type when the clock signal is maintained at the predetermined level for a first given time;

when the clock signal is maintained at the predetermined level for a second given time, switching a transmission type of the second data pin from an input type to an output type, wherein the first given time is less than or equal to the second given time; and after the transmission type of the second data pin is switched to the output type, outputting the clock signal having multiple pulses to the first timing pin via the second timing pin, and outputting a command signal to the first data pin in the input type via the second data pin in the output type in response to an edge of the clock signal.

8. The method for controlling an audio control device according to claim 7, wherein the first given time is greater than a time of a single pulse of the corresponding clock signal when the second data pin in the input type receives a digital audio signal.

9. The method for controlling an audio control device according to claim 7, further comprising:

after the transmission type of the second data pin is switched to the output type and before the command signal is output, outputting a starting signal to the first data pin in the input type via the second data pin in the output type.

10. The method for controlling an audio control device according to claim 9, wherein the starting signal is a signal transition, and a level of the clock signal corresponding to the signal transition is decided according to an edge of the clock signal to which generation of the command signal responds.

11. The method for controlling an audio control device according to claim 7, wherein the predetermined level is inverse to a level of the clock signal indicating a disabled state when the second data pin is in the input type.

* * * * *